US006557781B2

(12) United States Patent
Kon

(10) Patent No.: US 6,557,781 B2
(45) Date of Patent: May 6, 2003

(54) ROTARY ATOMIZING HEAD

(75) Inventor: Masatoshi Kon, Kakegawa (JP)

(73) Assignee: ABB K.K., Tokyo (JP)

( * ) Notice: Subject to any disclaimer, the term of this patent is extended or adjusted under 35 U.S.C. 154(b) by 0 days.

(21) Appl. No.: 10/168,541

(22) PCT Filed: Nov. 1, 2001

(86) PCT No.: PCT/JP01/09594

§ 371 (c)(1),
(2), (4) Date: Jul. 2, 2002

(87) PCT Pub. No.: WO02/43873

PCT Pub. Date: Jun. 6, 2002

(65) Prior Publication Data

US 2003/0010841 A1 Jan. 16, 2003

(51) Int. Cl.[7] ..... B05B 3/10

(52) U.S. Cl. ..... 239/224; 239/223; 239/104; 239/106; 239/700

(58) Field of Search ..... 239/104, 106, 239/110, 112, 223, 224, 700, 701, 702, 703, 704, 705

(56) References Cited

U.S. PATENT DOCUMENTS 4,405,086 A * 9/1983 Vetter ..... 239/224
5,897,060 A 4/1999 Kon et al.
5,909,849 A * 6/1999 Yamasaki et al. ..... 239/700
6,029,905 A * 2/2000 van der Steur ..... 239/222.11

FOREIGN PATENT DOCUMENTS

| | | |
|---|---|---|
| EP | 0 803 293 | 10/1997 |
| JP | 8-131903 | 5/1996 |
| JP | 9-234393 | 9/1997 |

* cited by examiner

*Primary Examiner*—Robin O. Evans
(74) *Attorney, Agent, or Firm*—Oblon, Spivak, McClelland, Maier & Neustadt, P.C.

(57) ABSTRACT

A main body (12) of a rotary atomizing head is provided with a hub fitting groove (13) on and around an inner peripheral surface (12F), while a hub member (14) is provided with a lid portion (15) of a circular disc-like shape, a plural number of leg portions (17) to be brought into fitting engagement with he hub fitting groove (13) through resilient deformation, and notched grooves (18) provided between the respective leg portions (17). Upon pushing in the hub member (14) against the main body (12), the leg portions (17) are fitted into the hub fitting groove (13) and the hub member (14) is mounted in position on the main body (12). In this assembled state, channel-like paint passages (19) are formed between the hub fitting groove (13) and the notched grooves (18), and an annular paint passage (20) is formed between the inner peripheral surface (12F) and the lid portion (15).

7 Claims, 7 Drawing Sheets

ROTARY ATOMIZING HEAD

TECHNICAL FIELD

This invention relates to a rotary atomizing head particularly suitable for use on a coating machine for coating vehicle bodies or other work pieces.

BACKGROUND ART

A rotary atomizing head type coating machine which is advantageous in terms of deposition efficiency and finish quality is generally resorted to for coating vehicle bodies or similar work pieces. A rotary atomizing head to be used on such a coating machine is largely constituted by an assembly of a main body and a hub member.

For instance, described in Japanese Laid-Open Patent Publication No. H9-234393 and its corresponding foreign patents U.S. Pat. No. 5,897,060 and EP0803293A1 is a rotary atomizing head type coating machine employing a rotary atomizing head body, which is provided with a rotational shaft mount portion on the rear side for mounting a rotational shaft of an air motor and which formed in a cylindrical or bell shape in a front portion forward of the rotational shaft mount portion. Further, the rotary atomizing head is provided with a paint spreading surface on the front portion toward marginal paint releasing edges for spreading paint into the form of a thin film, along with a paint reservoir which is formed on a deeper portion than the paint spreading surface. Furthermore, a stepped hub fitting portion is provided between the paint spreading surface and the paint reservoir of the rotary atomizing head body.

On the other hand, the hub member of the rotary atomizing head is fittingly mounted in position within the hub fitting portion in such a way as to cover the front side of the paint reservoir. The hub member is provided with a large number of paint outlet holes in its outer peripheral portions so that paint in the paint reservoir is allowed to flow out onto the paint spreading surface through the paint outlet holes.

An O-ring is fitted either in the inner periphery of the stepped hub fitting portion or on the outer periphery of the hub member, and the hub member is removably retained in the stepped hub fitting portion by resilient force of the O-ring.

At the time of washing the rotary atomizing head for a color change or for other purposes, normally the rotary atomizing head which is mounted on a coating machine is cleaned by the so-called automatic washing operation. Namely, in the case of an automatic washing operation, the rotary atomizing head is put in rotation at a high speed, and a wash fluid such as thinner is supplied from a feed tube to the paint reservoir of the rotary atomizing head thereby to wash away deposited paint from paint contacting portions including the paint reservoir, front and rear surfaces of the hub member, paint outlet holes and paint spreading surface. However, it is usually the case that, after an automatic washing operation, pigment components of the paint still remain and accumulate in or on the paint contacting portions although small in amount. Therefore, if the paint residues solidify in or on the paint contacting portions, the solidified pigments or other components have to be manually removed by the use of a brush or the like.

In the case of the rotary atomizing head according to the above-mentioned Japanese Laid-Open Patent Publication No. H9-234393, a hub member is removably mounted and retained on a stepped hub fitting portion by the use of resilient force of an O-ring. In this case, the O-ring has resiliency in such a degree as to be easily deformable when pushed. Therefore, when the rotary atomizing head is rotated at a high speed, for example, at a speed higher than 40,000 rpm, the inside diameter of the O-ring is increased by the centrifugal force which acts on the O-ring.

On the other hand, the rotary atomizing head and the hub member, which are generally formed of an aluminum alloy, stainless alloy or a hard synthetic resin material. Therefore, even when the rotary atomizing head is put in high speed rotation, deformations of the rotary atomizing head and the hub member under the influence of the centrifugal force are extremely small as compared with the extent of deformation of the O-ring.

This means that, when the rotary atomizing head is put in high speed rotation, the O-ring alone is spread to a larger diameter under the influence of the centrifugal force, losing the ability of holding or retaining the hub member securely in position. As a result of the weakened retention force of the O-ring, there may arise a problem that the hub member starts rattling within the stepped hub fitting portion.

Besides, repeated mounting and dismantling of the rotary atomizing head and the hub member can cause deteriorations in resilient force of the O-ring. If the rotary atomizing head is put in high speed rotation, the O-ring which is in such a deteriorated state in resilient force is no longer capable of securely supporting the rotary atomizing head, and the rotation of the rotary atomizing head becomes unstable. Further, as a result of repeated mounting and dismantling of the rotary atomizing head and the hub member, the O-ring undergoes abrasive wear due to frictional contact with associated parts and needs to be replaced at a high frequency.

Moreover, paint which comes out through the paint outlet holes flows into gap spaces between the stepped hub fitting portion and outer peripheral portions of the hub member during a coating operation, and pigment components of the paint tend to accumulate and solidify there even after conducting an automatic washing operation on the rotary atomizing head even at time of a color change or for other reasons. Therefore, in order to remove the solid contaminants like solidified pigments from the gap spaces, it becomes necessary to dismantle the hub member from the rotary atomizing head body. In such a case, it is often found difficult to dismantle the hub member readily from the main body of the rotary atomizing head because solidified pigments which has stuck into the gap spaces act like wedges. If one try to remove the hub member forcibly by applying strong forces to the rear side of the hub member by the use of a hammer or the like, those portions of the stepped hub fitting portion of the main body and the hub member which are in contacting engagement can be damaged to a serious degree.

On the other hand, the hub member is provided with a large number of paint outlet holes. However, for the purpose of distributing paint from the paint reservoir to the paint spreading surface of the rotary atomizing head, a large number of paint outlet holes of a relatively small diameter are provided along the outer periphery of the hub member. Therefore, as paint passes through the paint outlet holes, pigment components of the paint tend to deposit and accumulate on inner peripheral surfaces of the paint outlet holes, gradually constricting the inside diameter of the paint outlet holes.

As a result of paint deposition and accumulation, the paint outlet holes are varied in diameter. Therefore, paint which flows out onto the paint spreading surface through the paint outlet holes becomes unstable in flow rate, making it difficult to form a thin film of paint uniformly on the paint spreading surface and releasing from the paint releasing edges paint particles of such irregular sizes as would invite degradations in coating quality.

In addition, as the paint outlet holes are constricted in diameter, the paint reservoir is overly filled with paint which is not allowed to flow out smoothly through the paint outlet holes, and the paint begins to overflow into gap spaces around the rotational shaft to give adverse effects on the operation of the air motor.

In this regard, according to the prior art, a narrow rodlike (a needle-like) tool poked into the paint outlet holes one after another to remove accumulated and solidified paint therefrom. This paint removing job is extremely troublesome and time consuming and invites a serious drop in working efficiency.

DISCLOSURE OF THE INVENTION

In view of the foregoing situations, it is an object of the present invention to provide a rotary atomizing head employing a main body and a hub member which can be easily assembled and disassembled.

It is another object of the present invention to provide a rotary atomizing head which can retain a hub member securely within a hub fitting groove even when the rotary atomizing head is put in high speed rotation.

It is still another object of the present invention to provide a rotary atomizing head which permits to remove solidified pigments or other paint residues from paint passages in a facilitated manner.

The present invention is directed to a rotary atomizing head including a main body formed in a bell or tubular shape and having on the rear side a rotational shaft mount portion and on the front side a paint spreading surface extending toward marginal paint releasing edges for spreading paint into the form of a thin film and a paint reservoir provided in a receded deep portion of the main body, and a hub member fitted in an inner peripheral surface of the main body in such a way as to cover up front side of the paint reservoir.

According to the present invention, in order to solve the above-mentioned problems, there is provided a rotary atomizing head which is characterized in that: the main body is provided with a hub fitting groove around the inner peripheral surface between the paint reservoir and the paint spreading surface; the hub member is constituted by a lid portion of a circular disc-like shape having an outside diameter smaller than inside diameter of the inner peripheral surface on the side of the main body, a plural number of leg portions projected axially rearward from the lid portion and having distal end portions adapted to be brought into and out of engagement with the hub fitting groove through resilient deformation, and a plural number of notched grooves each provided between adjacent leg portions; and a plural number of channel-like paint passages are formed by and between the hub fitting groove and the notched grooves when the leg portions of the hub member are fitted in the hub fitting groove, and at the same time an annular paint passage is formed between the inner peripheral surface of the main body and circumferential surface of the lid portion.

With the arrangements just described, by holding the hub member against the main body in such a way as to cover the paint reservoir and then pushing it into the main body, the leg portions of the hub member, which are formed independently of each other, are resiliently deformed radially inward of the inner peripheral surface of the main body and then spread into a larger diameter upon engagement with the hub fitting groove. Consequently, the hub member is securely retained and stopped in the hub fitting groove by the resilient force of the leg portions. When the rotary atomizing head is put in high speed rotation, the respective leg portions of the hub member are spread into a larger diameter under the influence of centrifugal force and strongly pressed against the hub fitting groove to retain the hub member in position with greater retention forces.

Besides, when the hub member is set in the hub fitting groove, channel-like paint passages are formed between the notched grooves and the hub fitting groove, and at the same time the annular paint passage is formed between the lid portion of the hub member and the inner peripheral surface of the main body. Therefore, at the time of a coating operation, paint which has been supplied to the paint reservoir is urged to flow out onto the paint spreading surface through the respective channel-like paint passages and annular paint passage, and sprayed from the paint releasing edges in the form of finely atomized particles toward a work piece and deposited on the latter.

On the other hand, at the time of removing accumulated and solidified paint residues including solidified pigments or other components of paint from the respective channel-like paint passages and the annular paint passage, the hub member can be detached-from the main body simply by pushing a rear surface of the hub member through the rotational shaft mount portion on the front side of the main body. By so doing, the hub member can be easily disengaged from the hub fitting groove even when solidified paint residues are stuck in gap spaces between the respective leg portions and the hub fitting groove, because the leg portions undergo resilient deformation relatively easily in the same manner as they are pushed into the hub fitting groove. In a disassembled state, the channel-like paint passages are split into notched grooves on the side of the hub member and the hub fitting groove on the side of the main body, so that solidified paint residues like pigments can be easily removed from the notched grooves and the hub fitting groove by the use of a brush or the like. In addition, accumulated and solidified paint residues can also be easily removed from other liquid contacting portions including the inner peripheral surface of the main body and a paint receiving surface of the hub member.

According to the present invention, the leg portions and the notched grooves are formed alternately at and along outer periphery of the lid portion, and the channel-like paint passages are formed independently between the notched grooves and the hub fitting groove.

With the arrangements just described, paint which has been supplied to the paint reservoir is uniformly distributed to the annular paint passage through the respective channel-like paint passages.

According to the present invention, the annular paint passage is formed between and entirely around the inner peripheral surface of the main body and the circumferential surface of the lid portion of the hub member.

With the arrangements just described, paint which has been passed through the respective channel-like paint passages is supplied to the paint spreading surface through the annular paint passage.

According to the present invention, the leg portions are spread into a larger diameter in a direction away from the lid portion and toward the distal end portions.

With the arrangements just described, the distal ends of the respective leg portions, which are located in radially outermost positions, can be securely brought into fitting engagement with the hub fitting groove when the hub member is pushed into the main body.

According to the present invention, the hub fitting groove is connected to the inner peripheral surface of the main body through accurately rounded surfaces in front and rear boundary regions.

With the arrangements just described, paint is allowed to flow from the paint reservoir to the paint spreading surface, smoothly riding over the hub fitting groove without scattering around at the edges of the hub fitting groove.

According to the present invention, the annular paint passage is gradually diverged into a larger diameter in a forward direction.

With the arrangements just described, the inner peripheral surface of the main body is diverged in diameter from rear to front side thereof, so that, at the time of mounting the hub member on the main body, the leg portions of the hub member can be gradually bent toward the hub fitting groove through resilient deformation until they fall into engagement with the latter. In addition, paint which has been passed through the respective channel-like paint passages is supplied onto the paint spreading surface through the annular paint passage.

According to the present invention, the annular paint passage is a straight passage having substantially a uniform diameter in an axial direction.

With the arrangements just described, paint which has been passed through the respective channel-like paint passages is similarly supplied onto the paint spreading surface through is the annular paint passage.

BEST MODE FOR CARRYING OUT THE INVENTION

Figure 1:
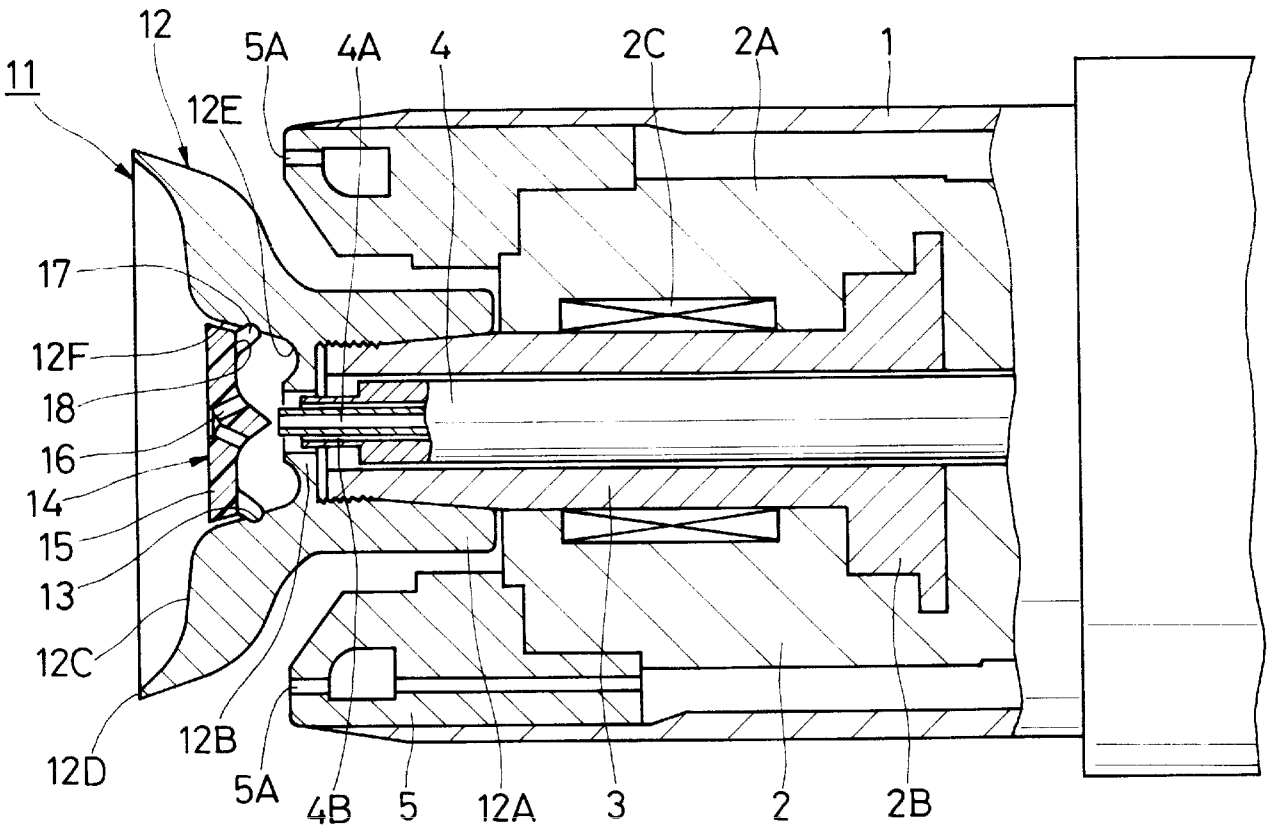
FIG. 1 is a schematic sectional view of a rotary atomizing head type coating machine with a rotary atomizing head embodying the present embodiment.

Hereafter, a rotary atomizing head type coating machine employing a rotary atomizing head according to the present invention is described more particularly by way of its preferred embodiment with reference to FIGS. 1 through 8.

In the drawings, indicated at 1 is a cover of a rotary atomizing head type coating machine, which is formed in a cylindrical shape to accommodate therein an air motor 2 as described below.

Denoted at 2 is the air motor which is housed in the cover 1. The air motor 2 is largely constituted by a tubular motor casing 2A, an air turbine 2B which is accommodated in the motor casing 2A, and a static air bearing 2C for rotatably supporting a rotational shaft 3, which will be described hereinafter. The air motor 2 drives the rotational shaft 3 by compressed air which is supplied to the air turbine 2B.

Indicated at 3 is a hollow rotational shaft which is rotatably supported by the static air bearing 2C of the air motor 2. The fore end of the rotational shaft 3 is projected on the front side of the air motor 2, a rotary atomizing head 11 is mounted on a projected fore end portion of the rotational shaft 3 as described more particularly hereinafter. The base end of the rotational shaft 3 is connected to the air turbine 2B.

Indicated at 4 is a feed tube which is passed through the hollow rotational shaft 3. The fore end of the feed tube 4 is projected forward of the rotational shaft 3 and extended into the rotary atomizing head 11. The feed tube 4 is of a coaxial double tube construction providing a paint passage 4A which is located centrally on the inner side to serve as a conduit for paint or a wash fluid like thinner, and an outer annular thinner passage 4B which is located on the outer side to serve as a conduit for thinner. At the time of a coating operation, paint is supplied through the paint passage 4A of the feed tube 4 toward the rotary atomizing head 11. On the other hand, at the time of a washing operation for a color change, for example, thinner is supplied through the paint passage 4A for washing front surfaces of the hub member 14, which will be described after, and at the same time thinner is supplied through the thinner passage 4B for washing the paint spreading surface 12C and paint releasing edges 12D of a main body 12.

Designated at 5 is a shaping air ring which is attached to the fore end of the cover 1. The shaping air ring 5 is generally formed in an annular shape and provided with a large number of air outlet holes 5A on its front side. The air outlet holes 5A are located on the front side of the shaping air ring 5 to spurt air for controlling a spray pattern of paint particles which are sprayed by the rotary atomizing head 11.

Figure 2:
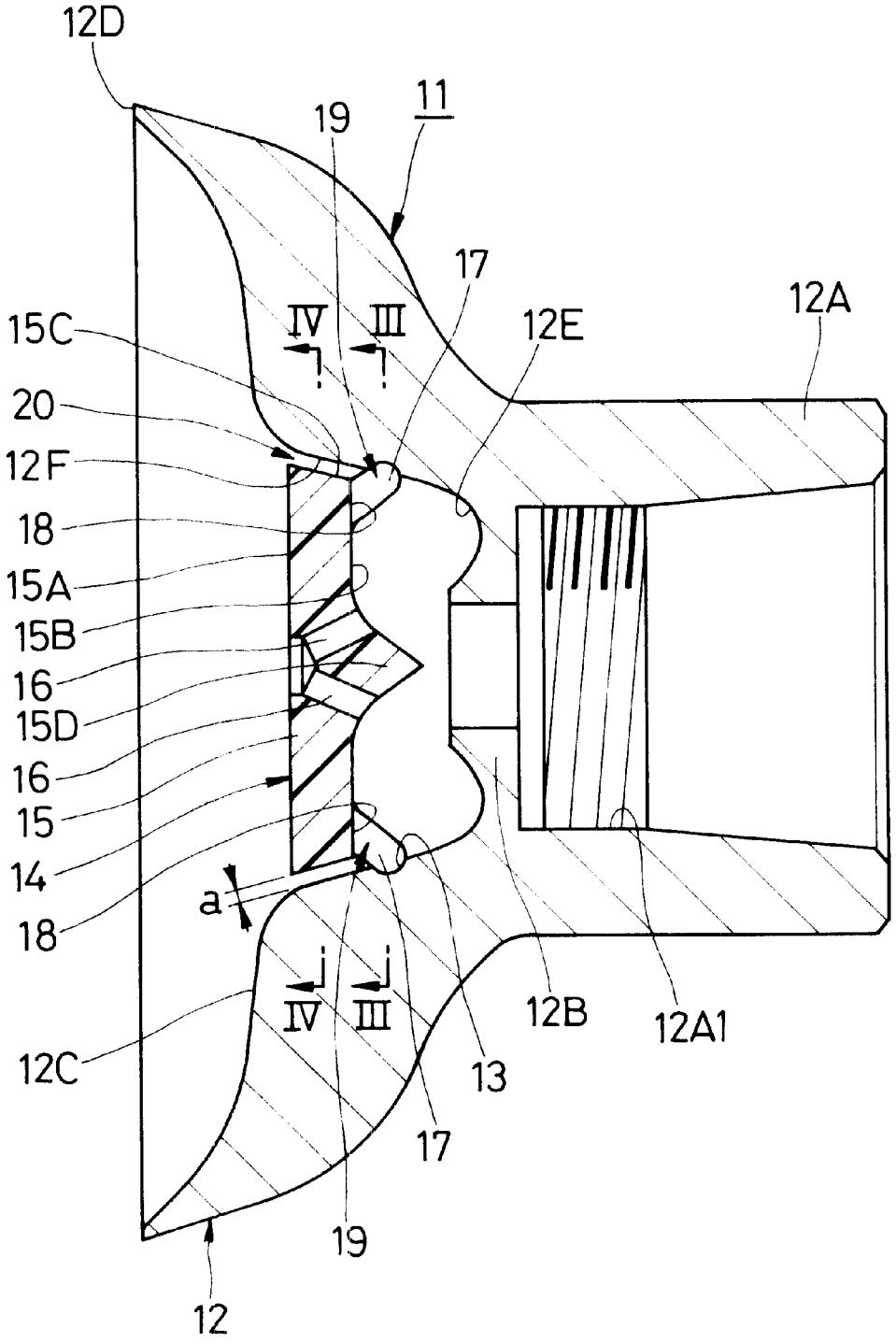
FIG. 2 is an enlarged sectional view of the rotary atomizing head shown in FIG. 1.

Now, indicated at 11 is a rotary atomizing head according to an embodiment of the present invention, which is mounted on a fore end portion of the rotational shaft 3. As shown in FIG. 2, the rotary atomizing head 11 is largely constituted by a main body 12, a hub fitting groove 13, a hub member 14, channel-like paint passages 19, and an annular paint passage 20.

Indicated at 12 is a main body of the rotary atomizing head 11, which defines the outer configuration of the rotary atomizing head 11 and which is diverged in a bell shape in a forward direction from its rear side. The main body 12 is formed, for example, of aluminum alloy, stainless alloy, hard synthetic resin material or the like. In this regard, in the case of a synthetic resin material, the main body 12 is entirely formed of a conductive synthetic resin material, or a conductive synthetic resin material is coated on a main body 12 of a non-conductive synthetic resin material. Accordingly, a high voltage can be applied to the main body 12 during a coating operation, and paint which flows on or along surfaces of the main body 12 can be directly charged with a high voltage.

On the rear side, the main body 12 of the rotary atomizing head is formed into a tubular rotational shaft mount portion 12A, which is provided with an internal or female screw portion 12A1 in a deep inner portion for threaded engagement with the rotational shaft 3 of the air motor 2. Further, the main body 12 is formed with an annular partition wall 12B which is projected radially inward in such a way as to block deep end portions of the rotational shaft mount portion 12A. A fore end portion of the feed tube 4, which is projected from the fore distal end of the rotational shaft 3, is inserted in the inner periphery of the annular partition wall 12B.

Figure 5:
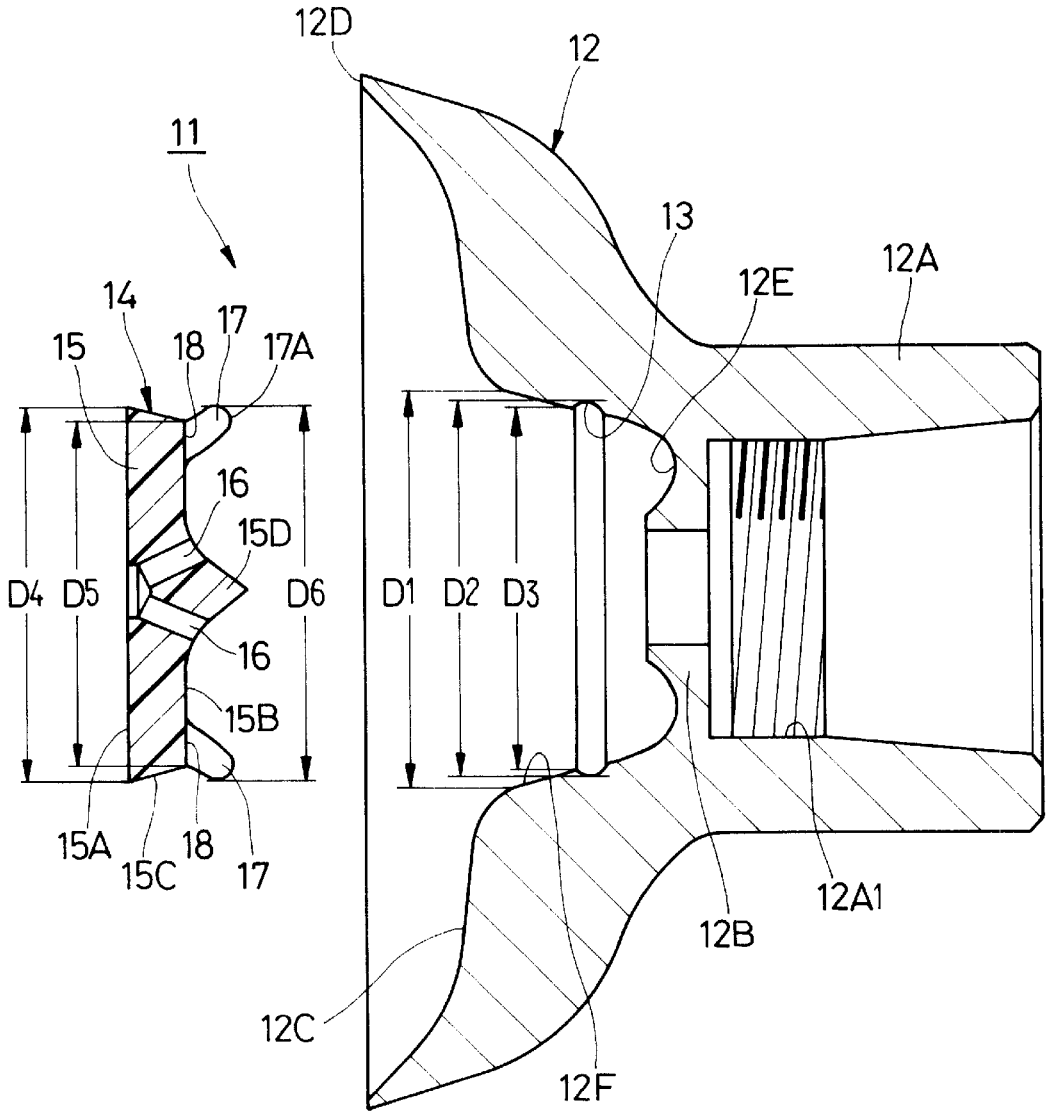
FIG. 5 is an exploded sectional view of a main body of the rotary atomizing head and a hub member.

On the other hand, on the front side, the main body 12 is provided with a forwardly diverging paint spreading surface 12C of a saucer-like shape, which is expanded continuously toward and as far as paint releasing edges 12D at the front end (at the outer end) of the main body 12 for spreading paint into a thin film. Further, the main body 12 is provided with a paint reservoir 12E in a deep portion between the annular partition wall 12B and the hub member 14, which will be described hereinafter. The paint reservoir 12E serves as a space for temporarily holding and spreading paint which is fed through the feed tube 4. Further, as shown in FIG. 5, an inner peripheral surface 12F between the paint reservoir 12E and the paint spreading surface 12C of the main body 12 is gradually increased in diameter in the forward direction to provide a forwardly diverging surface. Furthermore, at the front end (bounding on the paint spreading surface 12C), the forwardly diverging inner peripheral surface 12F is formed to have an inside diameter D1 larger than a maximum inside diameter D2 of a hub fitting groove 13 which will be described hereinafter (D1>D2).

As paint is supplied to the paint reservoir 12E on the main body 12 of the rotary atomizing head which is put in high speed rotation, the paint is fed onto the paint spreading surface 12C through channel-like paint passages 19 which will be described hereinafter. Then, the paint which has been supplied onto the paint spreading surface 12C is spread into the shape of a thin film and sprayed forward from the paint releasing edges 12D in the form of finely atomized particles.

Figure 6:
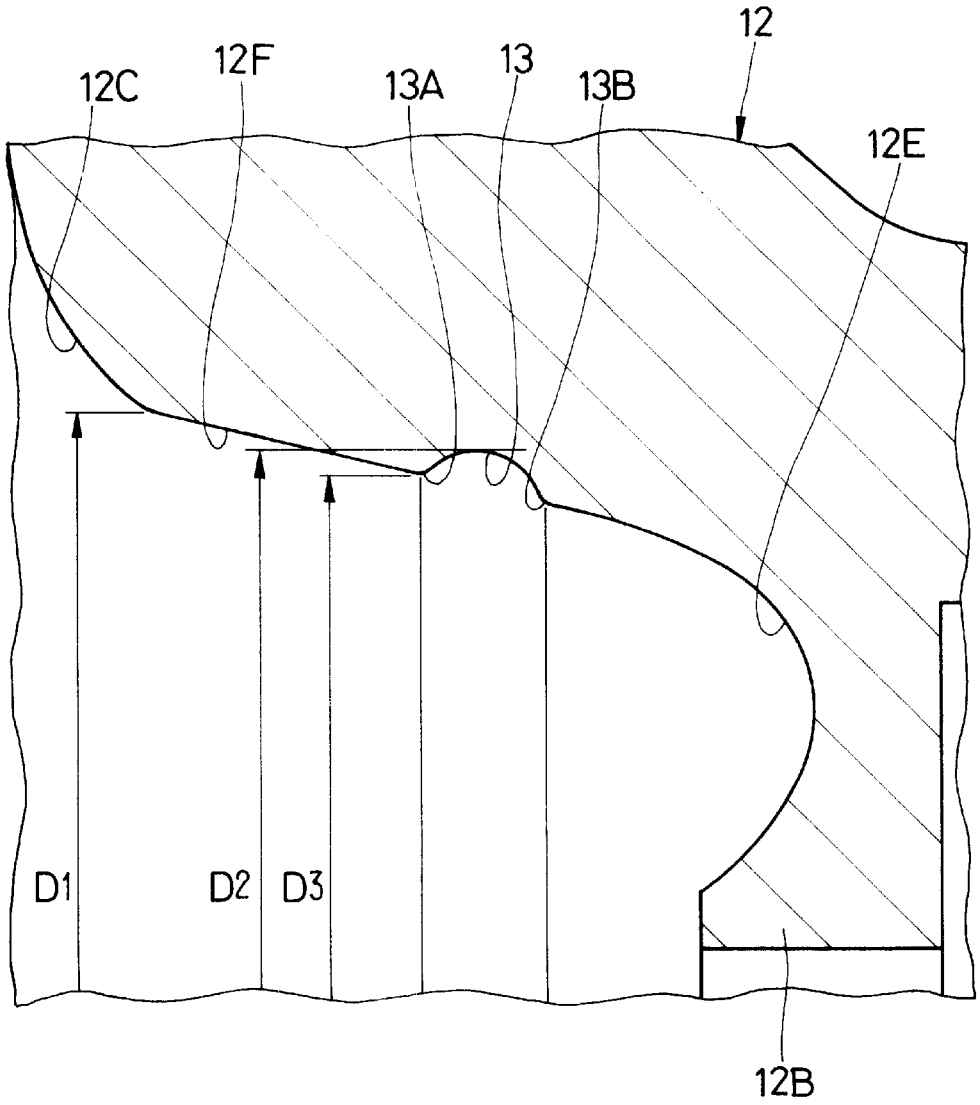
FIG. 6 is an enlarged sectional view, showing a hub fitting groove and associated parts on an enlarged scale.

Indicated at 13 is a hub fitting groove which is provided on an inner peripheral surface 12F of the main body 12. The hub fitting groove 13 is disengageably engaged with fore end portions of leg portions 17 of the hub member 14, which will be described after. The hub fitting groove 13 is formed around the forwardly diverging inner peripheral surface 12F at an intermediate portion between front and rear ends of the latter, and in an arcuate shape in cross section. Further, as shown in FIG. 6, the hub fitting groove 13 is adjoined with the inner peripheral surface 12F through accurately rounded surfaces 13A and 13B on the front and rear sides, respectively. These rounded surfaces 13A and 13B function to let paint flow across the hub fitting groove 13 smoothly without scattering as paint is supplied toward the paint spreading surface 12C from the paint reservoir 12E.

In this instance, the hub fitting groove 13 is arranged to have a maximum inside diameter D2 which is larger than inside diameter D3 of the front rounded surface 13A but smaller than inside diameter D1 at the front end of the forwardly diverging inner peripheral surface 12F (D1>D2>D3). Further, in this instance, arrangements are made such that the maximum inside diameter D2 of the hub fitting groove 13 is same as or slightly smaller than maximum outside diameter D6 of the leg portions 17 of the hub member 14, which will be described hereinafter (D2≦D6). With these arrangements, the leg portions 17 of the hub member 14 can be tightly snapped into the hub fitting groove 13, riding over the front accurately rounded surface 13A, and the hub member can be retained securely in the hub fitting groove 13 free of rattling movements.

Figure 7:
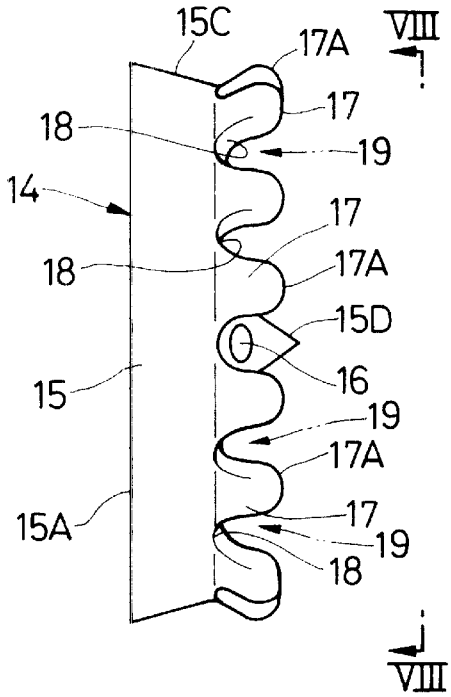
FIG. 7 is a schematic front view, showing the hub member alone on an enlarged scale.

Indicated at 14 is the hub member which is detachably mounted on the main body 12 of the rotary atomizing head in such a way as to cover up the front side of the paint reservoir 12E. The hub member 14 is formed substantially in a circular shape by the use of a material which is easily deformable under the influence of centrifugal force, namely, a synthetic resin material with suitable resiliency and flexibility such as polyether sulfon (PES), polyphenylene sulfide (PPS), polyether imide (PEI), polyether ether ketone (PEEK), polyoxymethylene (POM), polyamide imide (PAI), polyethyleneterephthalate (PET), polyimide (PI) and the like. As shown in FIG. 7, the hub member 14 is largely constituted by a lid portion 15, leg portions 17 and notched grooves 18.

The reference numeral 15 indicates a lid portion of a circular shape which constitutes a main body of the hub member 14. The lid portion 15 is located in such a way as to close the front side of the above-described paint reservoir 12E, and provided with a flat front surface 15A and a paint receiving surface 15B on its front and rear sides, respectively. Paint which is fed through and discharged from the feed tube 4 is received by the paint receiving surface 15B. In this case, the lid portion 15 has a circumferential surface 15C of an outside diameter which is gradually increased from its rear to front end, namely, having an outside diameter D4 at its front end which is larger than an outside diameter D5 at its rear end (D4>D5). The outside diameter D4 at the front end of the lid portion 15 is set at a value which is smaller than the inside diameter D1 at the front end of the forwardly diverging inner peripheral surface 12F of the main body 12 (D1>D4). Further, the outside diameter D5 at the rear end of the lid portion 15 is set at a value which is smaller than the inside diameter D3 at the accurately rounded surface 13A on the front side of the hub fitting groove 13 (i.e., at the rear end of the forwardly diverging inner peripheral surface 12F) (D3>D5).

On the other hand, a conical projection 15D which is projected in a rearward direction is formed at the center of the paint receiving surface 15B, thereby to smoothly handle paint which is discharged from the feed tube 4. In this instance, when the hub member 14 is mounted on the main body 12 of the rotary atomizing head, the circumferential surface 15C of the lid portion 15 is inwardly spaced from the inner peripheral surface 12F of the main body 12 by a gap of a predetermined width to provide an annular paint passage 20 which will be described hereinafter.

Denoted at 16 are four thinner outlet holes which are provided across and in center portions of the lid portion 15. More specifically, these thinner outlet holes 16 are bored through the paint receiving surface 15B (outer skirt portions of the conical projection 15D) and the front surface 15A of the lid portion 15. The thinner outlet holes 16 serve as passages for supplying thinner to the front surface 1SA from the side of the paint receiving surface 15B at the time of washing deposited paint off the front surface 15A.

Figure 8:
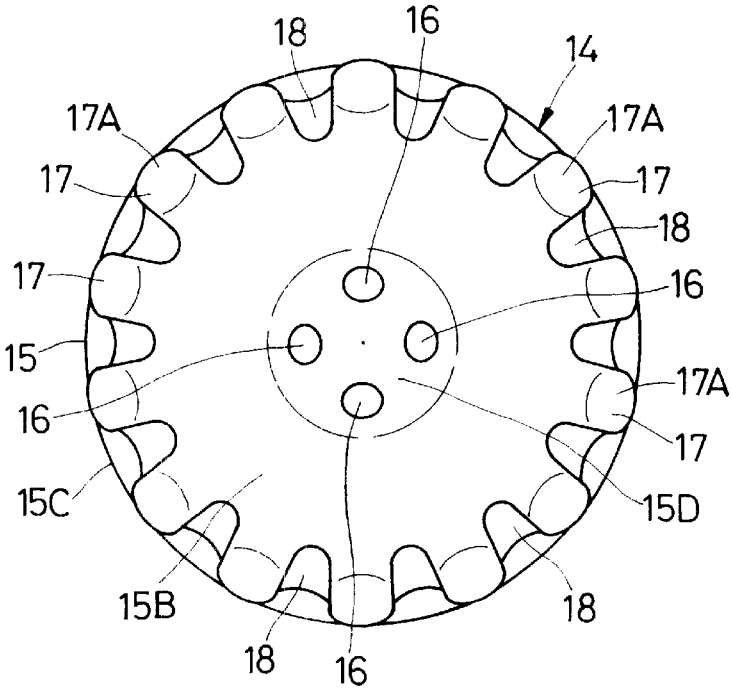
FIG. 8 is a right-hand side view of the hub member, taken in the direction of arrows VIII—VIII of FIG. 7.

Indicated at 17 are a plural number of leg portions (fourteen leg portions in the case of the particular embodiment shown) which are formed integrally with and at intervals along the outer periphery of the lid portion 15 on the rear end thereof. Namely, as shown in FIG. 8, these leg portions 17 are formed independently of each other and at uniform intervals at and along the outer periphery on the rear side of the lid portion 15. Further, the leg portions 17 are each extended in a radially outward direction from an outer peripheral edge portion on the rear side of the lid portion 15 and are gradually spread into a larger diameter as they are extended away from the outer periphery of the lid portion 15 toward outer distal ends 17A (in an axially rearward direction). Maximum outside diameter D6 at the outer distal ends 17A of the leg portions 17 is larger than the outside diameter D5 of the rear end of the lid portion 15 (D6>D5). Each one of the outer distal ends 17A of the leg portions 17 is a free end which is formed in a spherical shape substantially conforming with the profile of the hub fitting groove 13.

Moreover, the maximum outside diameter D6 at the outer distal ends 17A of the leg portions 17 is set at a value which is same as or smaller than the outside diameter D4 at the front end of the lid portion 15 (D6≦D4). Furthermore, the maximum outside diameter D6 (at the outer distal ends 17A) of the leg portions 17 is set at a value which is same as or slightly larger than the maximum inside diameter D2 of the hub fitting groove 13 (D6≧D2).

The leg portions 17, which are formed independently of each other, are resiliently deformable in a relatively easy manner and therefore can be easily fitted in or detached from the hub fitting groove 13. Besides, since the maximum outside diameter D6 at the outer distal ends of the leg portions 17 is same as or slightly larger than the maximum inside diameter D2 of the hub fitting groove 13, the respective leg portions 17 can be securely retained in the hub fitting groove 13.

As described above, the inside diameter D1 at the front end of the inner peripheral surface 12F, maximum inside diameter D2 of the hub fitting groove 13, and inside diameter D3 at the accurately rounded surface 13A on the front side of the hub fitting groove 13 on the main body 12, outside diameter D4 at the front end of the lid portion 15 of the hub member 14, outside diameter D5 at the rear end of the lid portion 15, and maximum outside diameter D6 at the outer distal ends 17A of the leg portions 17 of the hub member 14 are in the following dimensional relations (1).

$$\left.\begin{array}{l} D1 > D2 > D3, \\ D4 \geqq D6 > D5, \\ D6 \geqq D2, \\ D1 > D4, \text{ and} \\ D3 > D5 \end{array}\right\} \quad (1)$$

Indicated at 18 are a plural number of notched grooves (fourteen notched grooves in the case of the particular embodiment shown) which are formed alternately with the leg portions 17 in outer peripheral portions on the back side of the lid portion 15. These notched grooves 18 are each formed in U-shape between adjacent leg portions 17 and are located at uniform intervals along the outer periphery of the lid portion. When the leg portions 17 of the hub member 14 are fitted in the hub fitting groove 13, the notched grooves 18, form channel-like paint passages 19 between the hub fitting groove 13.

Figure 3:
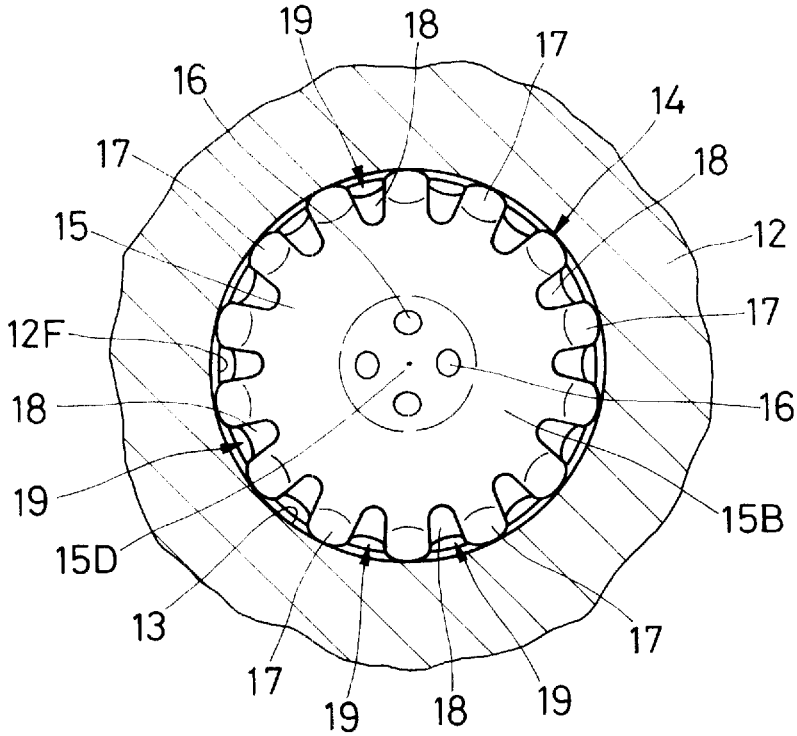
FIG. 3 is an enlarged sectional view of major component parts, taken in the direction of arrows III—III in FIG. 2.

Indicated at 19 are a plural number of channel-like paint passages which are formed between an inner peripheral surface of the hub fitting groove 13 and the respective notched grooves 18 when the hub member 14 is mounted and set in position on the main body 12. As shown in FIG. 3, the channel-like paint passages 19 are provided at uniform intervals in the circumferential direction, alternately with the leg portions 17 and in a large number which corresponds to the number of the notched grooves 18. As the rotary atomizing head 11 is put in high speed rotation and paint is supplied to the paint reservoir 12E from the feed tube 4, the channel-like paint passages 19 function to distribute paint uniformly toward an annular paint passage 20, which will be described hereinafter.

Figure 4:
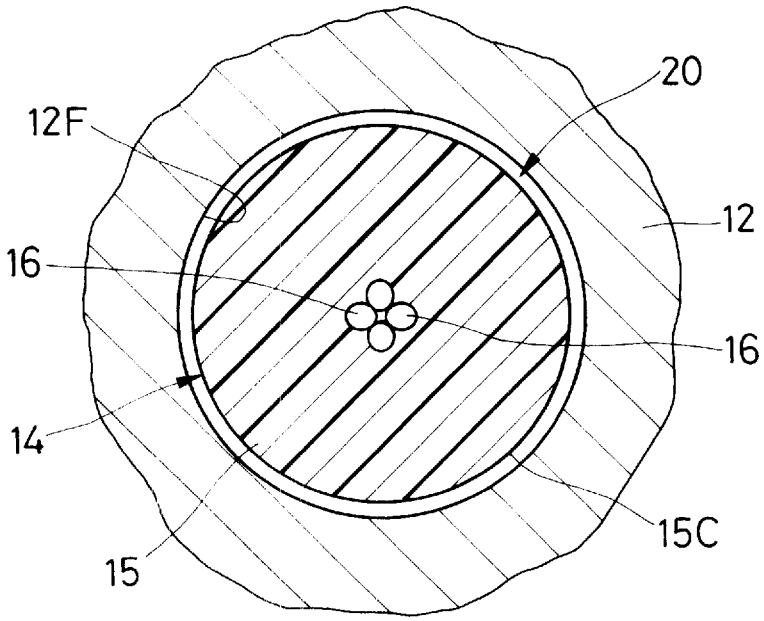
FIG. 4 is an enlarged sectional view of major component parts, taken in the direction of arrows IV—IV in FIG. 2.

Indicated at 20 is an annular paint passage which is formed between the forwardly diverging inner peripheral surface 12F of the main body 12 and circumferential surface 15C of the lid portion 15 when the hub member 14 is mounted on and set in position on the main body 12. As shown in FIGS. 2 and 4, the annular paint passage 20 is formed in a ring-like annular shape around between the circumferential surface 15C of the hub member 14 and the inner peripheral surface 12F of the main body 12, and is gradually increased in diameter in the forward direction. Accordingly, the forwardly spreading annular paint passage 20 is capable of distributing paint uniformly between the forwardly diverging inner peripheral surface 12F of the main body 12 and the circumferential surface 15C of the lid portion 15, and circulating thinner therethrough in contact with the above-mentioned surfaces 15C and 12F.

In this instance, the width a at the front end of the annular paint passage 20 (shown in FIG. 2) is in the following dimensional relations (2).

$$a \approx (D1 - D4)/2 \quad (2)$$

The rotary atomizing head 11, with the construction according to the present embodiment of the invention, is operated or handled in the manner as described below, in an assembling work, in a coating operation by the rotary atomizing head 11 and in removing (dissolving) solidified pigment component of paint after a coating operation.

For assembling the rotary atomizing head 11, the hub member 14 is mounted and set in position on the main body 12 in the manner as described below.

In the first place, one holds the hub member 14 in such a way as to cover the front side of the paint reservoir 12E, and pushes in the hub member 14 toward the paint reservoir 12E. At this time, since the inside diameter D1 at the front end of the forwardly diverging inner peripheral surface 12F of the main body 12 is larger than the maximum outside diameter D6 of the leg portions 17, the hub member 14 can be positioned at the center of the main body 12. Besides, along the inner peripheral surface 12F which is gradually reduced in diameter in an inward or rearward direction, the leg portions 17 of the hub member 14 can be gradually bent in a radially inward direction through resilient deformation until they ride over the front accurately rounded surface 13A on the front side of the hub fitting groove 13. Therefore, the leg portions 17 of the hub member 14 can be easily urged into fitting engagement with the hub fitting groove 13. Further, since the leg portions 17 are formed independently of each other, they can be flexed relatively easily and therefore can be urged into engagement with the hub fitting groove 13 quite easily.

In addition, the maximum outside diameter D6 of the leg portions 17 of the hub member 14, which are in engagement with the hub fitting groove 13, is same as or slightly larger than the maximum inside diameter D2 of the hub fitting groove 13, so that the respective leg portions 17 can be tightly and securely retained in the hub fitting groove 13.

Now, after assembling as described above, the rotary atomizing head 11 is used in a coating operation for spraying paint toward a work piece in the manner as follows.

Firstly, the rotary atomizing head 11 is rotationally driven from the air motor 2 through the rotational shaft 3 and put in high speed rotation, for example, at a speed of 3,000 to 100,000 rpm. At this time, centrifugal force acts on the main body 12 and the hub member 14 of the rotary atomizing head 11. However, the respective leg portions 17 of the hub member 14, which are formed independently of each other, are easily resiliently deformable and tend to spread in a radial direction to a greater degree than the main body 12. Therefore, the respective leg portions 17 are strongly pressed against the hub fitting groove 13 to retain the hub member 14 within the hub fitting groove 13 in a tight and secure manner all the more.

Upon supplying paint from the feed tube 4 toward the paint receiving surface 15B of the hub member 14, the paint which has been delivered to the paint receiving surface 15B is urged to flow from the paint reservoir 12E and then flow out onto the paint spreading surface 12C of the main body 12 through the respective channel-like paint passages 19 and the annular paint passage 20 under the influence of centrifugal force. At this time, since the channel-like paint passages 19 are formed at uniform intervals around the entire circumference of the lid portion 15, the paint which has been supplied to the paint reservoir 12E is uniformly distributed onto the paint spreading surface 12C on the main body 12 through the channel-like paint passages 19. In addition, since the annular paint passage 20 is formed in a predetermined width a, paint can be urged to flow out uniformly around the entire circumference of the lid portion. Paint is spread into a thin film on the paint spreading surface 12C and sprayed from the paint releasing edges 12D in the form of finely atomized particles toward a work piece to be coated.

During a coating operation, paint flowing on the surfaces of the main body 12 can be directly charged with a high voltage, by applying a high voltage to the rotary atomizing head 11 from a high voltage generator which is not shown. Charged paint particles are put on a flight toward a work piece and can be deposited on the latter at a higher deposition rate.

Now, upon finishing a coating operation in one color, the paint color can be changed in the manner as follows.

Firstly, prior to changing the paint color, a previous color which has deposited on various parts of the rotary atomizing head is washed off by the so-called automatic washing operation. In an automatic washing operation, while the rotary atomizing head 11 is put in high speed rotation, thinner is supplied to the paint passage 4A of the feed tube 4 and then from the paint passage 4B toward the rotary atomizing head 11. At this time, since the annular paint passage 20 with a predetermined width a is gradually diverged in diameter in the forward direction, thinner is also supplied to the circumferential surface 15C of the hub member 14.

Accordingly, deposited previous color on the forwardly diverging inner peripheral surface 12F and the circumferential surface 15C of the hub member can be efficiently washed off by the thinner which flows through the annular paint passage 20. In addition, deposited paint on the paint spreading surface 12C and paint releasing edges 12D of the main body 12 is washed off by thinner which flows out through the channel-like paint passages 19, while the front surface 15A of the hub member 14 is washed by thinner which flows out through the thinner outlet holes 16.

On the other hand, paint residues in gap spaces in or between the notched grooves 18, hub fitting groove 13 and the respective leg portions 17 of the hub member 14 are difficult to remove by the above-described automatic washing operation. Therefore, pigment components of deposited paint tend to accumulate and solidify little by little within the notched grooves 18 of the hub member 14 or similar parts. In order to remove solidified paint residues of this sort, the rotary atomizing head 11 is disassembled, for removing the solidified paint residues from the hub member 14 in a disassembled state. On such an occasion, for example, a rotary atomizing head is disassembled and solidified paint residues are removed in the manner as described below.

In the first place, the rotary atomizing head 11 is dismantled from the rotational shaft 3 prior to removing the hub member 14 from the main body 12. In the next place, a rod-like disassembling jig (not shown) is inserted into the rotational shaft mount portion 12A of the main body 12, pushing the hub member 14 with the jig from behind. By so doing, the hub member 14 can be easily dismantled from the hub fitting groove 13 through resilient deformation of the leg portions 17 which are formed independently of each other and easily resiliently deformable, for example, even in a case where solidified paint residues are stuck in gap spaces between the leg portions 17 and the hub fitting groove 13.

Upon removing the hub member 14 from the main body 12 in this manner, the respective channel-like paint passages 19 are divided into the hub fitting groove 13 on the side of the main body 12 and the notched grooves 18 on the side of the hub member 14. In this state, solidified paint residues can be easily removed simply by scraping the hub fitting groove 13 and the notched grooves 18 with a brush or the like. Solidified paint residues on other paint contacting parts, for example, on or in the paint reservoir 12E and inner peripheral surface 12F of the main body 12 and the circumferential surface 15C and leg portions 17 of the hub member 14, which are difficult to wash, can also be easily removed in a manner similar to the hub fitting groove 13 and the notched grooves 18.

Thus, according to the present embodiment of the invention, the main body 12 of the rotary atomizing head is formed of a metallic material or a hard synthetic resin material, while the hub member 14 is formed of a synthetic resin material with a suitable degree of resiliency and flexibility. In addition, the hub fitting groove 13 is provided on and around the forwardly diverging inner peripheral surface 12F, and the hub member 14 is provided with leg portions 17 to be disengageably engaged with the hub fitting groove 13. Accordingly, at the time of mounting the hub member 14 on the main body 12, the hub member 14 is held against the inner peripheral surface 12F of the main body 12 and then pushed in, whereupon the leg portions 17 of the hub member are forcibly urged into engagement of the hub fitting groove 13 through resilient deformation.

As a consequence, when the rotary atomizing head 11 is put in high speed rotation, the leg portions 17 of the hub member 14, which is formed of a synthetic resin material with a suitable degree of resiliency and flexibility, are strongly pressed against the bottom of the hub fitting groove 13 and therefore imparted with an enhanced retention force in holding the hub member 14 in position on the main body 12, precluding possibilities of falling accidents of the hub member 14 to ensure improved reliability of the rotary atomizing head 11. Besides, the rotational balance of the hub member 14 can be maintained in a stable state over a prolonged period of time.

On the other hand, at the time of removing accumulated and solidified pigments or other paint components from the notched grooves 18 and gap spaces between the hub fitting groove 13 and the respective leg portions 17 which are normally difficult to clean by an automatic washing operation, the hub member 14 can be easily detached from the main body 12 by pushing the hub member 14 from the side of the rotational shaft mount portion 12A of the main body 12 by the use of a disassembling jig. In the disassembled state, the channel-like paint passages 19 can be divided into the hub fitting groove 13 on the side of the main body 12 and the notched grooves 18 on the side of the hub member 14. Therefore, solidified paint residues in or on the hub fitting groove 13 and notched grooves 18 can be easily scrubbed off by the use of a brush or the like. This improves the efficiency of the cleaning job to a significant degree.

Further, the annular paint passage 20 is formed substantially in a uniform width a, so that paint can be distributed uniformly around the entire circumference during a coating operation, making it possible to improve the quality of coatings. On the other hand, at the time of a washing operation, deposited paint on the inner peripheral surface 12F of the main body 12 and the circumferential surface 15C of the hub member 14 can be washed off efficiently by thinner, permitting to finish the washing operation in an efficient manner.

Furthermore, since the leg portions 17 of the hub member 14 are formed independently of each other, they are resiliently deformable quite easily when bringing them into and out of engagement with the hub fitting groove 13. Accordingly, for example, even in a case where solidified pigments or other components of paint is stuck in the channel-like paint passages 19 between the leg portions 17 and the hub fitting groove 13 as mentioned hereinbefore in connection with the prior art, the hub member 14 can be put on or off easily by pressing or pulling with finger tips, facilitating the mounting and dismantling jobs to a considerable degree.

Moreover, the hub fitting groove 13 is connected to the forwardly diverging inner peripheral surface 12F through accurately rounded surfaces 13A and 13B at the front and rear boundary regions. Therefore, paint is allowed toward the paint spreading surface 12C from the paint reservoir 12E, smoothly riding over the hub fitting groove 13 without scattering around at the boundary regions. Thus, the accurately rounded surfaces 13A and 13B function to ensure smooth paint flow across the main body 12 and to improve the quality of coatings.

Further, by the provision of the annular paint passage 20 which is diverged or increased in diameter in the forward direction, the inner peripheral surface 12F of the main body 12 is also diverged in the forward direction from its rear end. Therefore, at the time of mounting the hub member 14 on the main body 12, the hub member 14 can be readily located at the center of the main body 12 and easily mounted in position on the latter in an accurate manner.

On the other hand, as described hereinbefore, the leg portions 17 of the hub member 14 are formed independently of each other and are relatively easily susceptible to resilient deformation, so that, even in a case where the hub member 14 is formed of a metallic material or a hard synthetic resin material similarly to the main body 12, each one of the leg portions 17 can be easily flexed and imparted with a sufficient retention force within the hub fitting groove 13.

In the foregoing preferred embodiment, the present invention has been described by way of a rotary atomizing head having the forwardly diverging inner peripheral surface 12F which is gradually increased in diameter in the forward direction between the main body 12 and the hub member 14 of the rotary atomizing head, along with the annular paint passage 20 which is also increased in diameter in the forward direction and formed between and along the inner peripheral surface 12F and the circumferential surface 15C of the lid portion 15.

Figure 9:
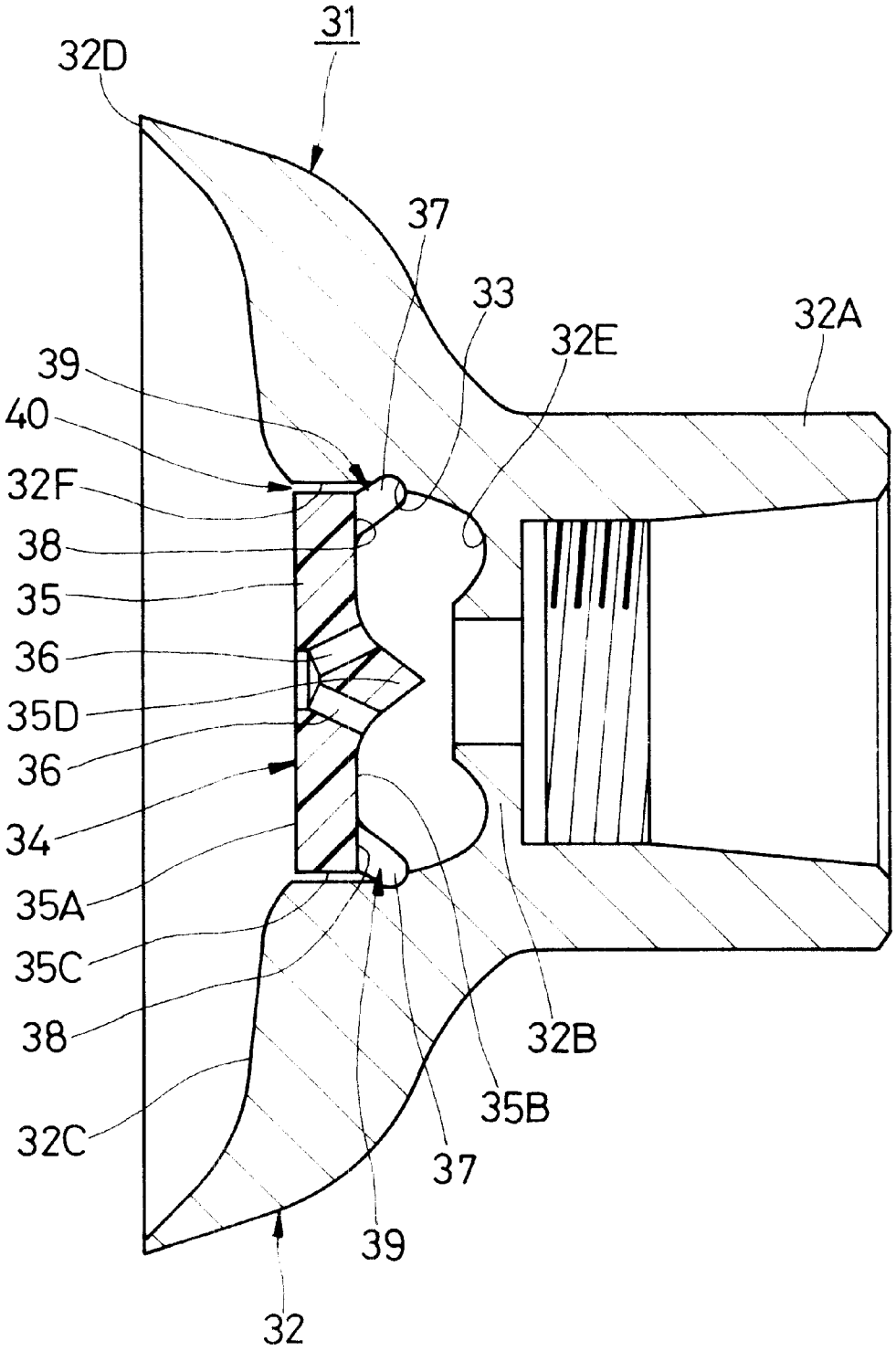
FIG. 9 is an enlarged sectional view similar to FIG. 2, but showing a modification of the rotary atomizing head according to the present invention.

However, the present invention is not limited to a rotary atomizing head as shown in the foregoing embodiment. For instance, the invention can be similarly applied to a rotary atomizing head 31 which is shown as a modification in FIG. 9. In this case, the rotary atomizing head 31 is largely constituted by a main body 32 having a rotational shaft mount portion 32A, an annular partition wall 32B, a paint spreading surface 32C, paint releasing edges 32D, a paint reservoir 32E, an inner peripheral surface 32F and a hub fitting groove 33 provided on the inner peripheral surface 32F, a hub member 34 having a lid portion 35, thinner outlet holes 36, leg portions 37 and notched grooves 38, and channel-like paint passages 39 which is formed between the hub fitting groove 33 and the notched grooves 38. An annular paint passage 40 with a uniform diameter from rear to front side is formed between the straight inner peripheral surface 32F having a substantially uniform diameter and a circumferential surface 35C of the lid portion 35.

Accordingly, in the case of this modification, paint which has passed through the channel-like paint passages 39 can be supplied to the paint spreading surface 32C by the straight annular paint passage 40 of uniform diameter. When a wash fluid like thinner is supplied, deposited paint residues in the annular paint passage 40 can be washed away with the wash fluid.

Further, in the particular embodiment shown, the hub member 14 is provided with fourteen leg portions 17. However, needless to say, the present invention is not limited to this particular arrangement. The number of leg portions 17 is not important as long as it is sufficient for retaining the hub member 14 securely on the main body 12 of the rotary atomizing head, namely, in some cases if suffices if the hub member 14 is provided with at least three leg portions at intervals in the circumferential direction. In a case where the hub member is provided with a reduced number of leg portions 17, the channel-like paint passages are elongated in the circumferential direction into the shape of a long slot or the like.

On the other hand, in the particular embodiment shown, the main body 12 of the rotary atomizing head 11 is formed of a metallic material or a conductive synthetic resin material to serve for a directly charging rotary atomizing head type coating machine in which paint is directly charged with a high voltage applied through the main body 12 or the like. However, the present invention is not limited to the directly charging type. For instance, the present invention is similarly applicable to an indirectly charging rotary atomizing head type coating machine which is provided with an external electrode on the outer side of the cover 1 for the purpose of indirectly charging sprayed paint particles.

Further, in the particular embodiment shown, the main body 12 of the rotary atomizing head is formed in a bell shape. However, the main body may be formed in a tubular shape which is gradually increased in diameter in the forward direction from the rotational shaft mount portion toward the paint releasing edges.

What is claimed is:

1. A rotary atomizing head including a main body formed in a bell or tubular shape and having on the rear side a rotational shaft mount portion and on the front side a paint spreading surface extending toward marginal paint releasing edges for spreading paint into the form of a thin film and a paint reservoir provided in a receded deep portion of the main body, and a hub member fitted in an inner peripheral surface of said main body in such a way as to cover up front side of said paint reservoir, characterized in that:

said main body is provided with a hub fitting groove around said inner peripheral surface between said paint reservoir and said paint spreading surface;

said hub member is constituted by a lid portion of a circular disc-like shape having an outside diameter smaller than inside diameter of said inner peripheral surface on the side of said main body, a plural number of leg portions projected axially rearward from said lid portion and having distal end portions adapted to be brought into and out of engagement with said hub fitting groove through resilient deformation, and a plural number of notched grooves each provided between adjacent leg portions; and a plural number of channel-like paint passages are formed by and between said hub fitting groove and said notched grooves when said leg portions of said hub member are fitted in said hub fitting groove, and at the same time an annular paint passage is formed between said inner peripheral surface of said main body and circumferential surface of said lid portion.

2. A rotary atomizing head as defined in claim 1, wherein said leg portions and said notched grooves are formed alternately at and along outer periphery of said lid portion, and said channel-like paint passages are formed independently between said notched grooves and said hub fitting groove.

3. A rotary atomizing head as defined in claim 1, wherein said annular paint passage is formed between and entirely around said inner peripheral surface of said main body and said circumferential surface of said lid portion of said hub member.

4. A rotary atomizing head as defined in claim 1, wherein said leg portions are spread into a larger diameter in a direction away from said lid portion and toward said distal end portions.

5. A rotary atomizing head as defined in claim 1, wherein said hub fitting groove is connected to said inner peripheral surface of said main body through accurately rounded surfaces in front and rear boundary regions.

6. A rotary atomizing head as defined in claim 1, wherein said annular paint passage is gradually diverged into a larger diameter in a forward direction.

7. A rotary atomizing head as defined in claim 1, wherein said annular paint passage is a straight passage having substantially a uniform diameter in an axial direction.

* * * * *

UNITED STATES PATENT AND TRADEMARK OFFICE

CERTIFICATE OF CORRECTION

PATENT NO. : 6,557,781 B2
DATED : May 6, 2003
INVENTOR(S) : Kon

It is certified that error appears in the above-identified patent and that said Letters Patent is hereby corrected as shown below:

Title page,
Insert Item [30], Foreign Application Priority Data:

-- [30] Foreign Application Priority Data

Nov. 30, 2000 (JP) ..... 2000-365651 --

Signed and Sealed this

Twenty-sixth Day of August, 2003

JAMES E. ROGAN
*Director of the United States Patent and Trademark Office*